US009376834B2

(12) United States Patent
Liang et al.

(10) Patent No.: US 9,376,834 B2
(45) Date of Patent: Jun. 28, 2016

(54) SCREWLESS SASH LOCK FOR METAL AND PLASTIC WINDOW SASHES AND THE LIKE

(75) Inventors: Luke Liang, Plainfield, NJ (US); Tong Liang, Guang Zhou (CN); David Chen, Guang Zhou (CN)

(73) Assignee: VISION INDUSTRIES GROUP, INC., So. Plainfield, NJ (US)

( * ) Notice: Subject to any disclaimer, the term of this patent is extended or adjusted under 35 U.S.C. 154(b) by 701 days.

(21) Appl. No.: 13/462,950

(22) Filed: May 3, 2012

(65) Prior Publication Data

US 2012/0284993 A1 Nov. 15, 2012

Related U.S. Application Data

(60) Provisional application No. 61/518,798, filed on May 11, 2011.

(51) Int. Cl.

| | |
|---|---|
| ***E05B 1/00*** | (2006.01) |
| ***E05B 9/08*** | (2006.01) |
| ***E05C 3/04*** | (2006.01) |
| *E05C 7/00* | (2006.01) |

(52) U.S. Cl.

CPC . *E05B 9/08* (2013.01); *E05C 3/046* (2013.01); *E05B 1/0015* (2013.01); *E05C 2007/007* (2013.01); *Y10T 29/49876* (2015.01); *Y10T 292/1056* (2015.04); *Y10T 292/1077* (2015.04)

(58) Field of Classification Search

CPC ..... E05B 1/00; E05B 9/08; E05C 2007/007
USPC ..... 292/95, 121, 124, 126, 128, 98, 292/100–103, 107, 108
See application file for complete search history.

(56) References Cited

U.S. PATENT DOCUMENTS

| | | | | |
|---|---|---|---|---|
| 684,497 | A * | 10/1901 | Davies | 292/31 |
| 5,110,165 | A * | 5/1992 | Piltingsrud | 292/242 |
| 5,715,563 | A * | 2/1998 | Marks | B60S 1/4003 15/250.32 |
| 6,142,541 | A | 11/2000 | Rotondi | |
| 6,401,302 | B1 | 6/2002 | Josserand et al. | |
| 6,634,683 | B1 | 10/2003 | Brannan | |
| 7,017,957 | B2 | 3/2006 | Murphy et al. | |
| 7,731,251 | B2 | 6/2010 | Ye | |
| 2009/0039657 | A1 * | 2/2009 | Schuck | 292/300 |

* cited by examiner

*Primary Examiner* — Kristina Fulton
*Assistant Examiner* — Thomas Neubauer
(74) *Attorney, Agent, or Firm* — Thomas A. O'Rourke; Bodner & O'Rourke, LLP

(57) ABSTRACT

A lock adapted for attachment to a sash window/door without screws comprises: a shaft with a cam secured thereon is rotatably secured to a housing, with the cam disposed within a housing cavity and rotatable therefrom out of an opening, into an extended position. The housing may be a single integrally formed wall that preferably has a flat bottom surface. A first attachment leg protrudes out from the housing cavity to extend beyond the bottom surface, with a foot thereon extending beyond a first end of the housing. A second attachment leg protrudes out the housing cavity second end, with a foot thereon oriented toward the housing first end, and a locking tab extends from the housing bottom surface. Installation of the screwless sash lock is by receiving the first foot, second foot, and locking tab within correspondingly positioned openings in the window/door rail, through sequenced rotational and sliding motion.

14 Claims, 23 Drawing Sheets

FIG. 14Bii

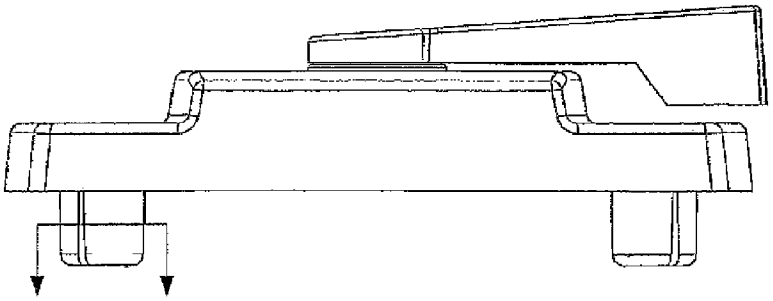
FIG. 19A
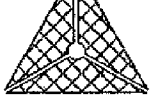
FIG. 19B
FIG. 19C
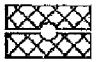
FIG. 19D
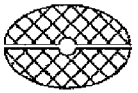
FIG. 19E
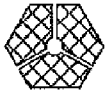
FIG. 19F
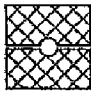
FIG. 19G

SCREWLESS SASH LOCK FOR METAL AND PLASTIC WINDOW SASHES AND THE LIKE

CROSS REFERENCES TO RELATED APPLICATIONS

This application claims priority on U.S. Provisional Application Ser. No. 61/518,798 having the title, "Sash Lock for Metal and Plastic Window Sashes and the Like," filed on May 11, 2011, the disclosures of which are incorporated herein by reference.

FIELD OF THE INVENTION

The present invention is directed to improvements in sash locks and handles, and more particularly to a screwless means for securing sash locks to window sashes that are hollow in at least the region where the sash lock is secured to the window sash.

BACKGROUND OF THE INVENTION

There are scores of issued sash lock utility patents, which invariably utilize screws for mounting of the lock to a window. See, for example, U.S. Pat. No. 7,731,251 to Ye for "Compact Sliding Sash Lock"; U.S. Pat. No. 7,017,957 to Murphy for "Sash Lock for Sash Window"; and U.S. Pat. No. 6,142,541 to Rotondi for "Pick Resistant Sash Lock." The use of separate mechanical fasteners for mounting of the sash locks can provide a satisfactory means of attachment, even where the lock itself is manufactured of a composite material, necessitating that the requisite amount of care must be taken to not over-torque the metallic screws and cause failure of the lock's non-metallic housing. An alternative mounting scheme that does not necessitate such caution in the amount of torque utilized for such mounting screws, would be an advantageous improvement over the prior art sash locks.

In addition, acquiring a competitive advantage in these marketplaces dictates that a product and process be characterized by greater efficiency and less waste, and which furthermore serves to optimize flow of production parts, assemblies, and installations. This has become known as "lean manufacturing." The sash lock of the present invention offers several alternative embodiments that reduce or completely eliminate the use of mechanical fasteners for securing of the sash lock to a window or door, and offers a lean manufacturing approach to both production of the sash lock and its installation onto the window/door. The attachment means disclosed herein may also be utilized for other applications, such as, for example, the attachment of a handle.

OBJECTS OF THE INVENTION

It is an object of the invention to provide a sash lock that may be easily and quickly secured to, and/or removed from, a sash window or a sash door.

It is another object of the invention to provide a sash lock housing that may be secured to a sash window/door without requiring the use of mechanical fasteners.

It is a further object of the invention to provide a sash lock housing that may be removed from a sash window/door without requiring the removal of mechanical fasteners.

It is another object of the invention to provide a sash lock housing that may be secured to a hollow sash window/door using only one mechanical fastener.

Further objects and advantages of the invention will become apparent from the following description and claims, and from the accompanying drawings.

SUMMARY OF THE INVENTION

A sash lock is adapted for attachment to a sash window or sash door without screws, and may comprise: a shaft with a cam secured thereon, being rotatably secured to a housing, with the cam disposed within a housing cavity and rotatable therefrom out of an opening into an extended position. The housing may be a single integrally formed wall that forms a cavity and preferably has a flat bottom surface. A first attachment leg may protrude out from the housing cavity at a first end of the housing, with a down-standing leg portion extending beyond the bottom surface, and with a foot thereon extending beyond a first end of the housing. The foot may have a generally flat top surface that transitions into an angled surface near its joining to the down-standing leg portion. A second attachment leg may protrude out the housing cavity at the housing second end, with a down-standing leg portion extending beyond the bottom surface, and with a foot thereon being oriented toward the housing first end. The foot of the second leg may have a first angled top surface that meets a second angled top surface to form an apex. A rectangular locking tab may also extend from a portion of the housing bottom surface.

The screwless sash lock may be installed onto a sash window meeting rail (or a sash door stile), which may have formed coordinated openings in the top surface of the meeting rail. The coordinated openings may comprise a first elongated opening, a second elongated opening, and a third opening, with the first, second, and third openings being selectively spaced in a relation corresponding to the relation between the foot of the first leg, the foot of the second leg, and the locking tab of said sash lock housing.

Installation of the screwless sash lock onto the meeting rail of the sash window/door may occur by first inserting the foot of the first leg of the lock housing, at an angle, so as to enter through the first elongated opening in the meeting rail. Next, rotation of the screwless sash lock permits the foot of the second leg to become proximate to the second elongated opening in the meeting rail, with a top surface of the foot of the first leg contacting the underside of the rail-stile wall, and with the locking protrusion contacting the rail-stile wall outside of the cavity. Pressure may then be applied to the second end of the housing to cause deformation of the housing and/or rail, to thereby force the foot of the second leg to enter through the second elongated opening to be disposed within the hollow rail/stile. Transitioning to application of a sliding force upon the screwless sash lock housing, in the same direction as the foot of the first and second legs, results in the angled top surface of the foot of the second leg causing downward deformation of the foot relative to the housing bottom surface, until the apex contacts the underside of the rail/stile wall, which results in a friction fit between the rail/stile wall, and the housing foot apex and housing bottom surface. Continued sliding of the screwless sash lock until the locking tab is received in the third opening in the rail will reduce or eliminate the deformation, with the bottom surface of the housing becoming flush with a top surface of the rail/stile wall, and with a side surface of the first and second legs contacting the first and second elongated openings to have the housing cover the first, second and third rail openings.

BRIEF DESCRIPTION OF THE DRAWINGS

FIG. 14Bii is an enlarged cross-sectional view of the foot of FIG. 13Bii, but having a convex outer leg surface rather than a concave outer surface.

FIG. 19A is a side view of the third embodiment of the sash lock according to FIG. 18A.

FIG. 19B is a cross-section through the expansion anchor of the sash lock of FIG. 19A, showing a first configuration for the expandable sections of the expansion anchor.

FIG. 19C is a cross-section through the expansion anchor of the sash lock of FIG. 19A, showing a second configuration for the expandable sections of the expansion anchor.

FIG. 19D is a cross-section through the expansion anchor of the sash lock of FIG. 19A, showing a third configuration for the expandable sections of the expansion anchor.

FIG. 19E is a cross-section through the expansion anchor of the sash lock of FIG. 19A, showing a fourth configuration for the expandable sections of the expansion anchor.

FIG. 19F is a cross-section through the expansion anchor of the sash lock of FIG. 19A, showing a fifth configuration for the expandable sections of the expansion anchor.

FIG. 19G is a cross-section through the expansion anchor of the sash lock of FIG. 19A, showing a sixth configuration for the expandable sections of the expansion anchor.

DETAILED DESCRIPTION OF THE INVENTION

Figure 1:
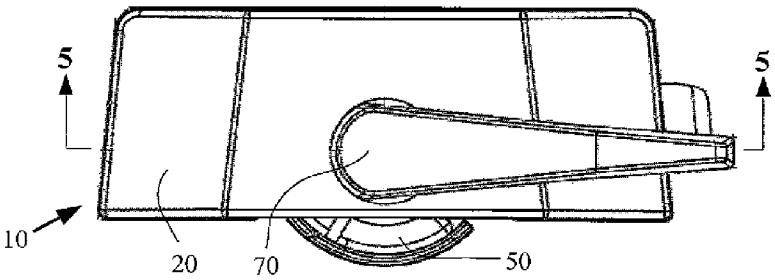
FIG. 1 is a top view of a first embodiment of the screwless sash lock of the current invention.

A first embodiment of the screwless sash lock 10 according to the current invention is shown in FIGS. 1-6. The screwless sash lock 10 may be installed onto a sash window or door that has already been installed into a building, or the sash lock 10 may be installed during the assembly of the window and prior to its installation. As seen in the exploded view of FIG. 7, parts comprising the screwless sash lock 10 may include a housing 20, a cam 50, a shaft 70, a spring 80, and a wedge 90.

The housing 10, as well as the other component parts of the lock, may be a metallic material and be formed through a machining, forging or casting process, or may be made of a plastic material and be formed through an injection molding process, or it may be a composite part. The housing 20 may be dome-shaped, or rectangular, or elongated, or any other suitable shape. The housing 20 may have a first end 21, a second end 22, and may comprise only a single, integrally formed housing wall with an exterior surface 23 (FIG. 5), an interior surface 24 that creates a cavity and which may be a direct offset of the exterior surface, and a bottom surface 25 that may, but need not necessarily be, a generally planar surface. The rail or stile, onto which the sash lock 10 is to be attached, may be curved, and therefore the bottom surface 13 of the sash lock housing, instead of being planar, may comprise corresponding curvature. Also, the single housing wall may be formed to comprise a smooth curved exterior surface (e.g., the "dome" shape), or it may be formed to include discrete angular or faceted portions, which may be functional, or may simply provide an aesthetically suitable appearance.

Protruding from the housing 20 of screwless sash lock, may be at least one key feature being usable for the attachment of the sash lock to the rail/stile of the window or door, without the need for screws or other mechanical fasteners.

Figure 2:
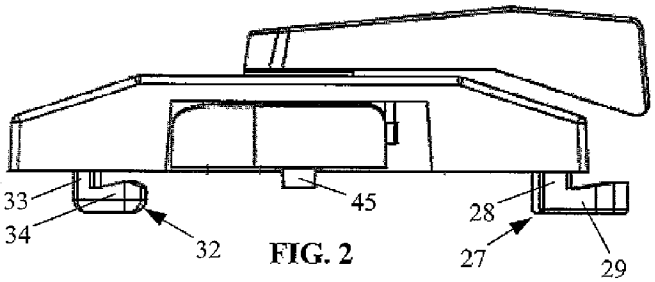
FIG. 2 is a side view of the screwless sash lock of FIG. 1.
Figure 5:
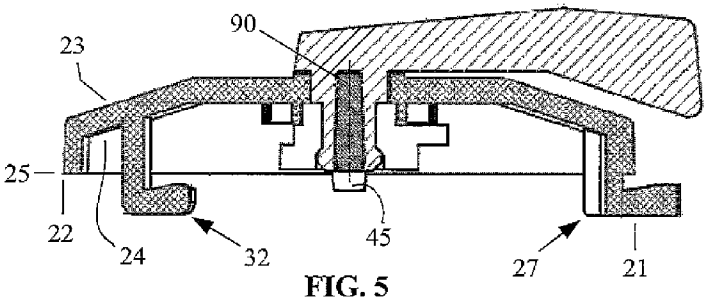
FIG. 5 is a cross-sectional view through the mounting legs of the screwless sash lock of FIG. 1.
Figure 5A:
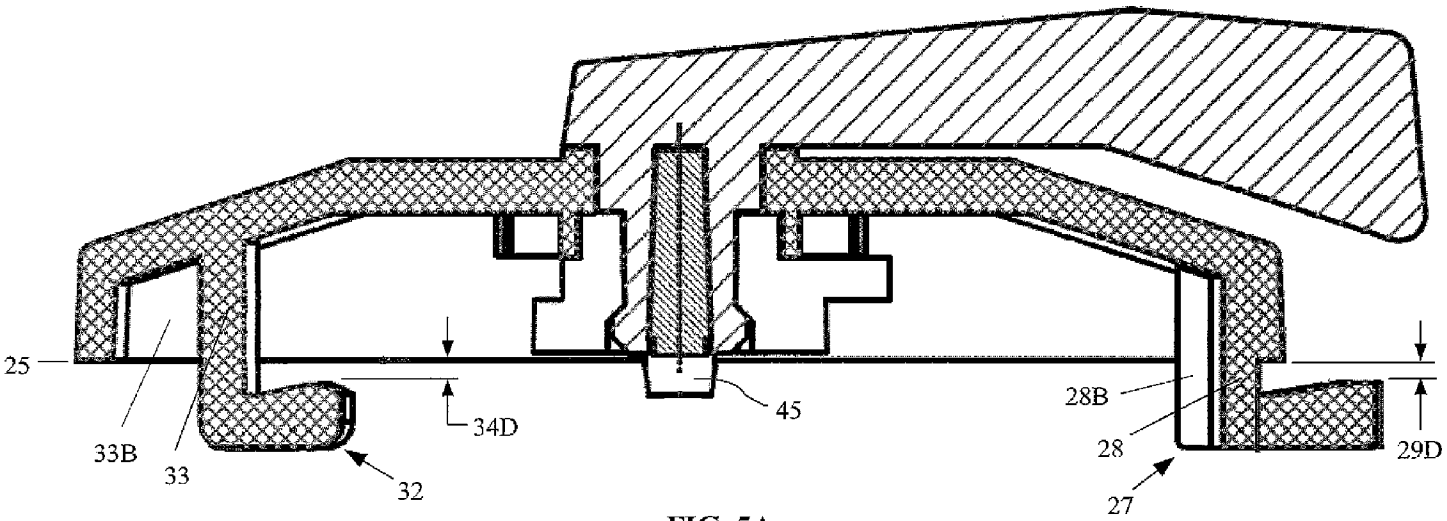
FIG. 5A is an enlarged reproduction of the cross-sectional view of FIG. 5.
Figure 5C:
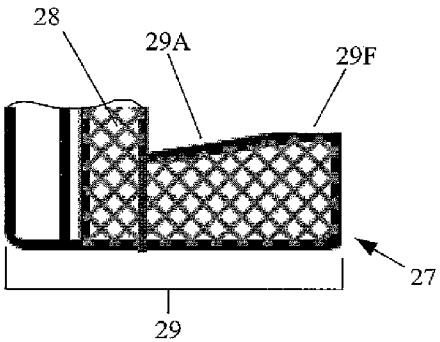
FIG. 5C is the cross-sectional view of FIG. 5A enlarged to show the foot of the first leg.
Figure 5B:
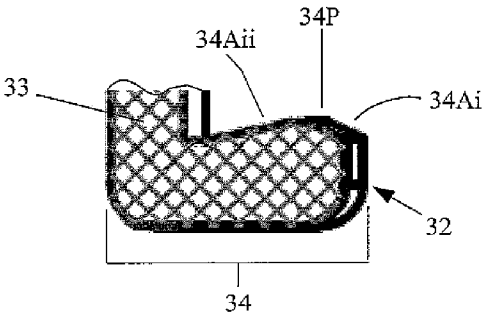
FIG. 5B is the cross-sectional view of FIG. 5A enlarged to show the foot of the second leg.

For sash lock 10, protruding from the interior surface 24 of the housing cavity at the first end 21 of the housing 20 may be a first leg 27 (see FIGS. 2 and 5A). First leg 27 may comprise a down-standing leg portion 28 and a foot portion 29. The down-standing leg portion 28 may protrude out from the housing cavity from the interior surface 24 of the housing wall, and extend beyond the bottom surface 25. It should be noted that the use herein of the term "down-standing" is merely intended to be descriptive in informing the reader as to the particular element being discussed, based upon its appearance in the drawing figure, without intending to limit the final orientation of the lock itself, as the lock may be installed on the horizontal meeting rail of a sash window, with the "down-standing leg" actually ending up being oriented vertically, or the lock may be installed on the vertical stile of a sash door, where the "down-standing" leg would actually end up being oriented horizontally.

The down-standing leg portion 28 may extend out from the housing cavity from the interior surface 24 of the housing wall in general proximity to the first end of the housing, and preferably will contact and/or be integrally formed with a side of the housing wall, as seen in FIG. 5A. The down-standing leg portion 28 may be stiffened against flexing excessively through the use of integral stiffeners 28A and 28B (see FIGS. 5A and 6). The top surface of the foot portion 29 may have a flat section 29F that may be parallel to, but displaced from, the generally flat bottom surface 25 of the housing 20. The flat section 29F of the top surface may transition into an angled section 29A that terminates at the down-standing leg portion 28. The distance 29D between the plane formed by the generally planar bottom surface 25 of the housing and the flat section 29F of the top surface of the foot portion 29 may be advantageously selected to accommodate installation of the screwless sash lock, as discussed hereinafter.

Protruding from the interior surface 24 of the housing cavity near the second end 22 of the housing 20 may be a second leg 32. Second leg 32 may comprise a down-standing leg portion 33 and a foot portion 34. The down-standing leg portion 32 may also protrude out from the housing cavity from the interior surface 24 of the housing wall, and extend beyond the bottom surface 25. The second leg 32 may preferably be proximate to the housing second end, but displaced from the side of the housing wall, with the foot portion 34 being oriented so as to point in the same direction as the foot portion 29 of the first leg 27. To avoid being cantilevered an excessive distance from the housing, the second leg 32 may be supported by stiffeners 33A and 33B. The top surface of the foot portion 34 may comprise an apex 34P formed by a first angled surface 34Ai and a second angled surface 34Aii, which terminates at the down-standing leg portion 33. The distance 34D between the plane formed by the generally planar bottom surface 25 of the housing and the apex 34P of the top surface of the foot portion 32 may similarly be advantageously selected to accommodate installation of the screwless sash lock, as discussed hereinafter.

Another feature on the housing 20 of the sash lock 10 of the present invention to accommodate screwless attachment is a locking tab, which may be positioned in one of several locations. Locking tab 45 may protrude from the bottom surface 25 of the housing 20, as seen in FIGS. 1-6, and may be a generally rectangular-shaped protrusion. Either side or both sides of the rectangular locking tab 45 may be slightly tapered to facilitate installation of the sash lock.

Assembly of the shaft 70, cam 50, and wedge 90 into the housing may generally be similar to the assembly of the corresponding parts within our co-pending application Ser. No. 13/283,976, the disclosures of which are incorporated herein by reference. As seen herein within the exploded view in FIG. 7, the shaft 70 may have a cylindrical portion 70C that is rotatably received within an orifice in the housing wall, with a portion of the shaft being disposed within the housing cavity, and a graspable portion of the shaft being disposed outside of the wall. The graspable portion may simply comprise a portion of the shaft 70 having a larger diameter to form a knob, or it may instead have an ergonomic handle portion that extends generally orthogonally away from the shaft. Rectangular prongs 70Pi and 70Pii, extending from the shaft bottom, may be received in a corresponding opening in the cam 50, to thereby fixedly secure the cam to the shaft. The wedge 90, as discussed in more detail in the above mentioned co-pending application, further serves to affix the cam to the shaft.

Figure 3:
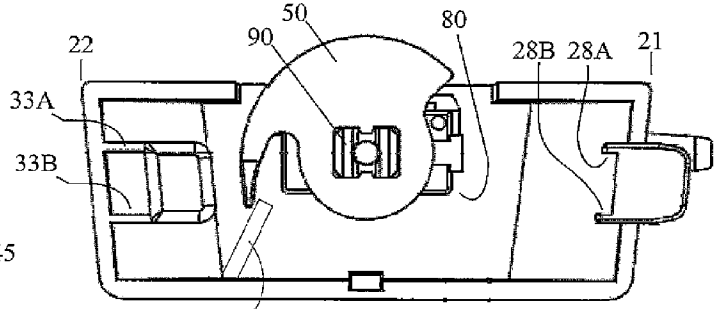
FIG. 3 is a bottom view of the screwless sash lock of FIG. 1.
Figure 4:
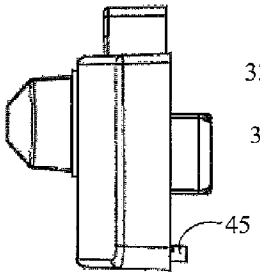
FIG. 4 is an end view of the screwless sash lock of FIG. 1.
Figure 6:
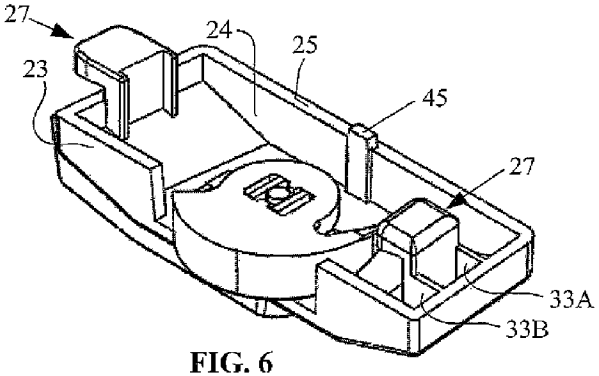
FIG. 6 is a bottom perspective view of the screwless sash lock of FIG. 1.
Figure 7:
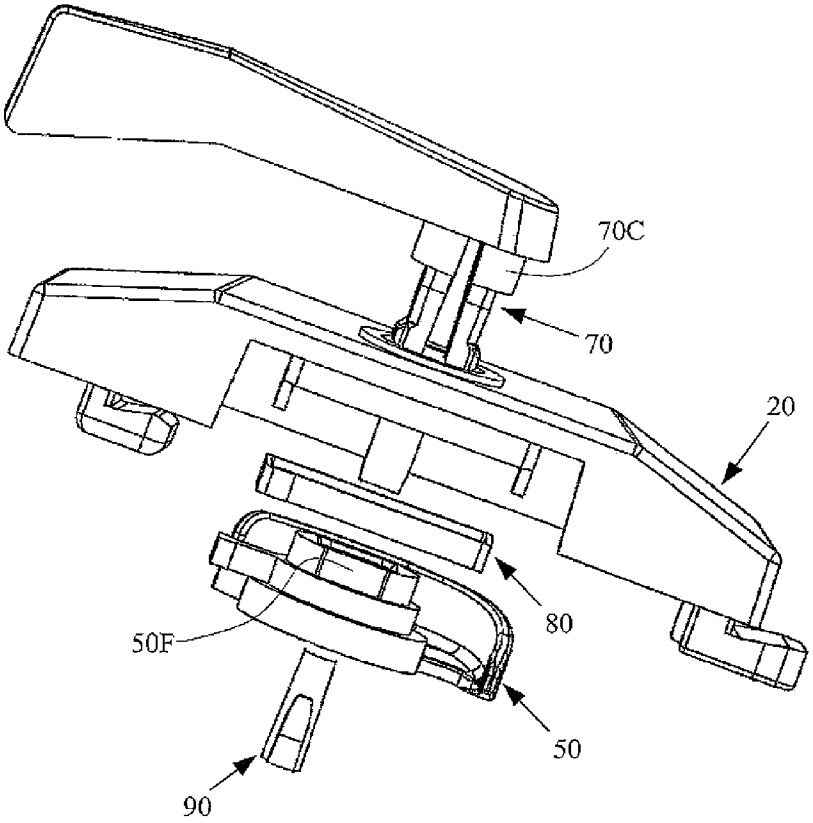
FIG. 7 is an exploded view of the screwless sash lock of FIG. 1.

A leaf-type spring 80 may be used to serve as a detent for the handle when at the locked position, in which at least a portion of the cam has been rotated and extends out through an opening in the housing to engage a keeper on the adjacent sash or master frame, and as a detent when at the unlocked position, when the majority or all of the cam is disposed within the housing cavity. The leaf type spring may be as disclosed in the above mentioned co-pending application, or instead, a leaf-type spring 80 may be multi-sided, even rectangular, as seen in FIGS. 3 and 7, in which it is held within the cavity using suitable housing protrusions. One side of the multi-sided leaf-type spring 80 may, when the cam 50 is in the extended position (FIG. 3), serve to restrain pivotal motion of the cam by contacting a flat portion 50F on the cam (FIG. 7). When the cam is rotated to the retracted position, the flat portion 50F of the cam 50 may contact the opposite side of the multi-sided leaf spring 80, to thereby restrain pivotal motion of the cam. Alternatively, rather than using a multi-sided leaf spring 80, a single-sided member may be engaged by first and second flat portions on opposite sides of the cam, to also serve as a detent at the unlocked and locked positions. A stop member 20S (FIG. 3) being integral to the housing and protruding into the cavity, may be positioned to inhibit rotational motion of the cam at both the retracted and extended positions by contacting opposite ends of the generally crescent-shaped cam 50 profile.

Figure 8A:
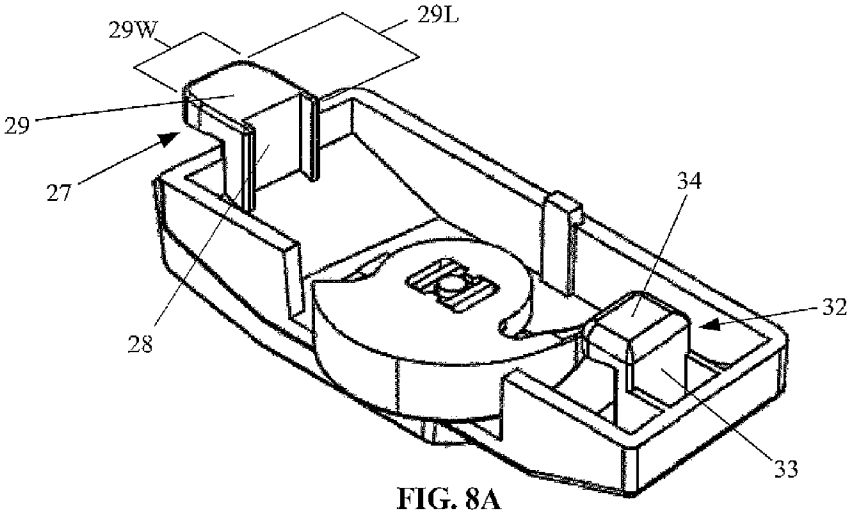
FIG. 8A is the bottom perspective view of FIG. 6 enlarged.
Figure 8B:
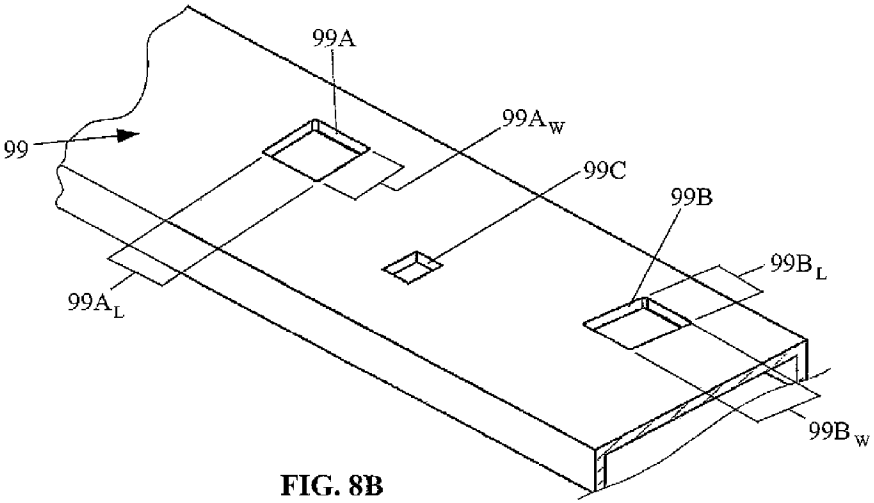
FIG. 8B is a perspective view of a rail/stile member of a sash window/door, having corresponding openings thereon to receive the attachment members of the sash lock of FIG. 1.

Installation of the screwless sash lock 10 may be generally understood from viewing FIGS. 8A and 8B. The sash stile or rail 99 of the window or door may have first and second openings 99A and 99B, having a width that corresponds to the width of the foot portions 29 and 34 of the first and second legs 27 and 32. A third opening 99C in the sash stile or rail 99 may correspond to the size and shape of the locking tab 45. The process of installing the sash lock is seen within FIGS. 9A-9D.

Figure 9A:
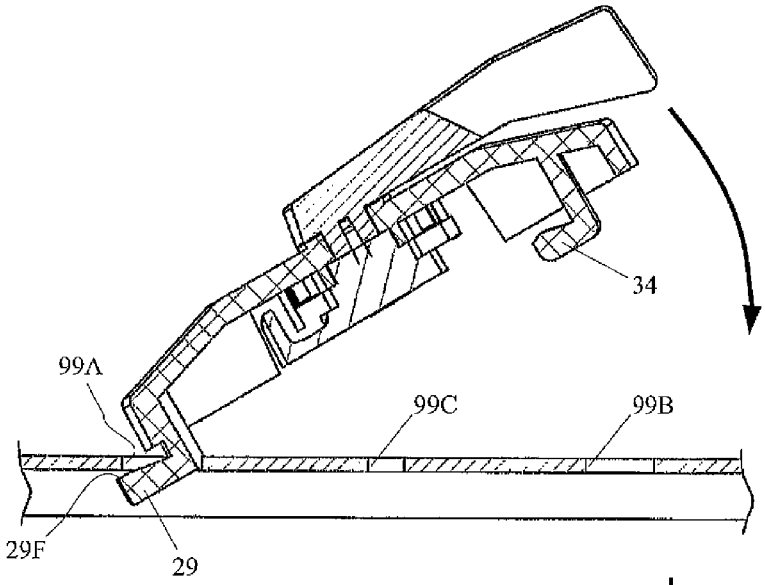
FIG. 9A is a cross-sectional view of the screwless sash lock of FIG. 1, at the first step of its installation into the rail/stile of FIG. 8B.
Figure 9B:
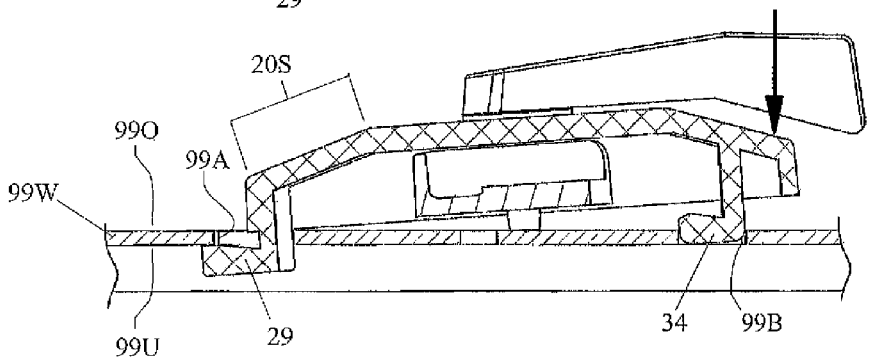
FIG. 9B is a cross-sectional view of the screwless sash lock of FIG. 1, at the second step of its installation into the rail/stile of FIG. 8B.
Figure 9C:
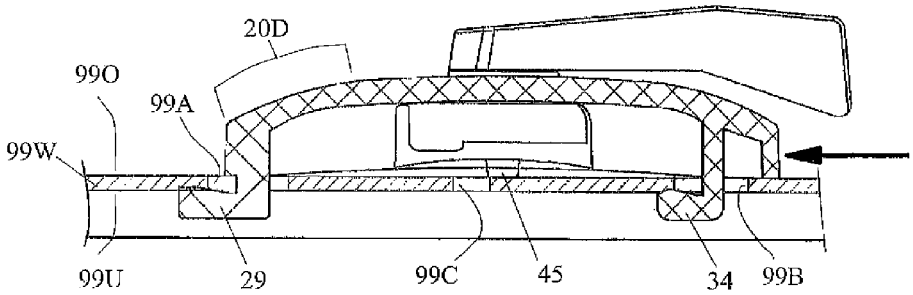
FIG. 9C is a cross-sectional view of the screwless sash lock of FIG. 1, at the third step of its installation into the rail/stile of FIG. 8B.
Figure 9D:
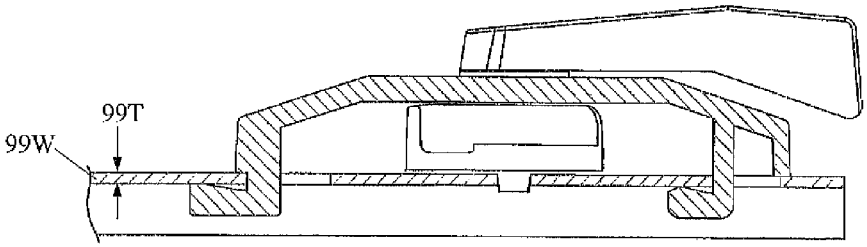
FIG. 9D is a cross-sectional view of the screwless sash lock of FIG. 1, after being installed into the rail/stile of FIG. 8B, with the foot of the first leg and foot of the second leg received in the rail/stile openings, and the locking tab on the housing bottom surface receiving in its corresponding rail-stile opening.

Installation of the sash lock 10 may begin by inserting the foot 29 of the first leg 27 of the housing at an angle, to enter through the first elongated opening 99A in the rail/stile 99, as seen in FIG. 9A. Next, the sash lock may be rotated with the top surface 29F of the foot 29 of the first leg 27 contacting the underside 99U of the rail/stile 99. Rotation may continue, with the foot 34 of the second leg 32 approaching and becoming proximate to the second opening 99B of the rail/stile 99, until the locking protrusion 45 contacts the outer surface 99O of the rail/stile, as seen in FIG. 9B. At this point, a downward force (see arrow) must be applied to the second end 22 of the housing 20 to cause elastic deformation of the housing, and thereby permit the foot 34 of the second leg 32 to enter through the second elongated opening 99B to be disposed generally below the underside 99U of the rail/stile. Deformation will occur in the housing, and may also occur in the wall 99W of the rail/stile locally about the locking tab 45, because the locking tab 45 is jammed up against the wall from the rotation of the sash lock 10. This deformation is visibly illustrated and recognizable in comparing the faceted side 20S of the housing wall in FIG. 9B, with the deformed housing wall 20D in FIG. 9C. At this point in the installation, a lateral sliding force (see arrow in FIG. 9C) must be applied to the second end of the housing and be in the same direction as are oriented the feet 29 and 34 on the first leg 27 and second leg 32. The angled surface 34Ai of the second foot may serve to deflect the foot away from the rail-stile wall 99W until the apex 34P contacts the underside 99U of the rail/stile Wall 99W, resulting in a friction fit between the rail/stile wall 99W and both the housing bottom surface 25 and the apex 34P of foot 34. A similar friction fit may also exist between the rail/stile wall 99W and both the housing bottom surface 25 and the flat surface section 29F on the top surface of the foot portion 29. The friction fit is obtained by utilizing a smaller distance 29D on the foot 29 of the first leg 27, and a smaller distance 34D on the foot 34 of the second leg 32, than is the thickness 99T of the wall 99W of the rail/stile 99.

Continued application of the sliding force to the sash lock may occur until the locking tab 45 has been received within the third opening 99C of the rail/stile, at which point the deformation may have been substantially reduced, and the bottom surface 25 of the housing 20 is flush with the outer surface 99O of the rail/stile. In addition, at this point, the housing wall now covers the first, second, and third rail openings, 99A, 99B, and 99C.

In order for the foot 34 of the second leg 32 to be received through the corresponding opening 99B in the rail/stile during rotational motion of the sash lock, that rail-stile opening 99B must be slightly larger than the footprint of foot 34 (see profile of foot 34 and opening 99B in FIG. 9B). In the case of the first leg 27, the footprint of foot 29 and the size/shape of opening 99A must adhere to other requirements. The width 99Aw of opening 99A (FIG. 8B) must be slightly larger than the width 29W (FIG. 8A) of the foot 29. However, the length 29L of the foot 29 of the first leg 27 may, but need not be, larger than the length $99A_L$ of opening 99A on the rail/stile. From viewing FIG. 9B, it may be realized that if the length 29L of the foot 29 of the first leg 27 (including stiffeners 28A and 28B) is smaller than the length $99A_L$ of opening 99A on the rail/stile to offer a clearance fit, then both the first end of the housing and the second end of the housing will need to be depressed by the worker installing the screwless sash lock to deform the housing 20, to permit insertion of feet 29 and 34 through the respective openings, while the locking tab 45 is bearing against the outer surface 99O of the rail/stile.

If instead, the length 29L of the foot 29 of the first leg 27 is, in fact, larger than the length $99A_L$ of opening 99A, then it permits a more advantageous installation of the sash lock whereby the foot 29 may be hooked through the smaller opening 99A, as previously described, to be retained therein by contact between the flat section 29F of the top surface of the foot portion 29 and the underside 99U of the rail/stile. Thus, the worker installing the screwless sash lock would only need to depress the second end of the housing to cause deformation and insertion of the foot 34 through opening 99B—an arrangement which would also more naturally transition to the next installation step, which requires the user to maintain the downward force while also beginning to apply the lateral sliding force that causes positioning of the locking tab 45 within opening 99C.

Figure 10A:
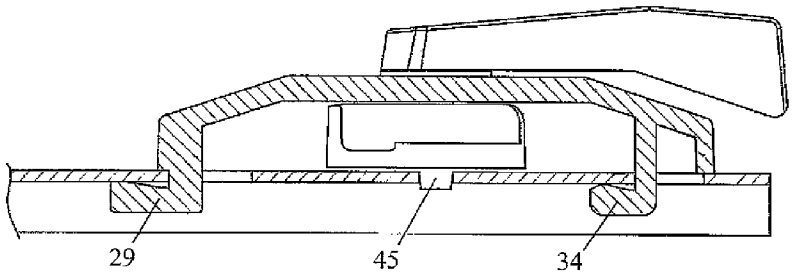
FIG. 10A is the cross-sectional view of the screwless sash lock of FIG. 9D.
Figure 10B:
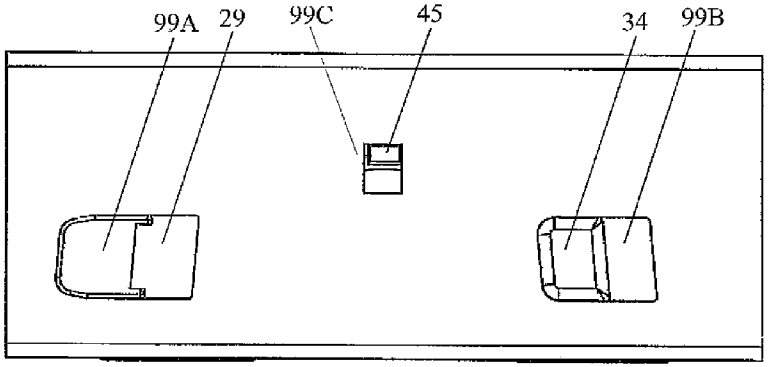
FIG. 10B is a bottom view of the rail/stile having the screwless sash lock according to FIG. 10A installed thereon, and showing the first foot and second foot of the legs and the locking tab secured in the corresponding openings in the rail/stile.
Figure 10D:
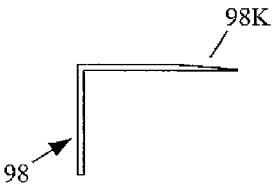
FIG. 10D is a side view of a tool being usable to aid in removing the screwless sash lock from the rail/stile.
Figure 10C:
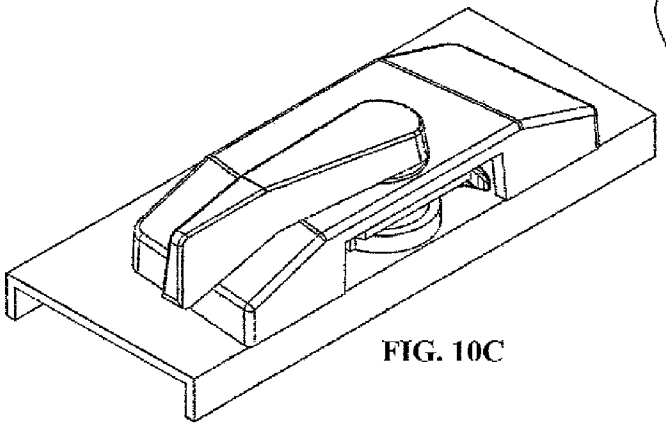
FIG. 10C is a perspective view of the screwless sash lock installed on the rail/stile.
Figure 10E:
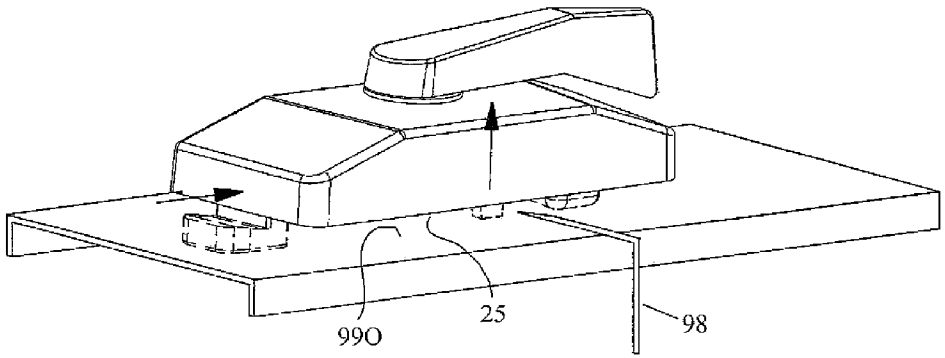
FIG. 10E is a perspective view showing the tool of FIG. 10D advancing toward the interface between the lock housing and the rail/stile surface, to cause local separation therebetween to disengage the locking tab from the corresponding opening in the rail/stile, to thereafter permit sliding removal of the foot of the first and second legs for removal of the lock.

Removal of the screwless sash lock 10 from the rail/stile may be easily accomplished, and may be understood from viewing FIGS. 10A-10E. FIGS. 10A and 10B show the sash lock 10 installed on the rail/stile 99, with the wall 99W of the stile being in a friction fit (or possibly even a small clearance fit) between the top surface of feet 29/34 and the bottom surface 25 of the housing 20, and with the locking tab 45 engaged within the rail/stile opening 99C. A slender object, such as a thin screw-driver blade, or a knife blade, or a simple tool, such as tool 98 having a knife-edge 98K, as illustrated in FIG. 10D, may be used to remove the sash lock 10. As seen in FIG. 10E, inserting of the slender portion of the tool between the bottom surface 25 of housing 20 of the sash lock, and the outer surface 99O of the rail/stile, may be used to exert a normal force (see vertical arrow) that causes the locking tab 45 to be withdrawn from the opening 99C. A lateral sliding force applied to the first end of the housing will then cause the foot 34 of the leg 32 to exit opening 99B of the rail/stile, and the sash lock 10 can now be counter-rotated to remove the foot 29 from opening 99A.

Figure 9E:
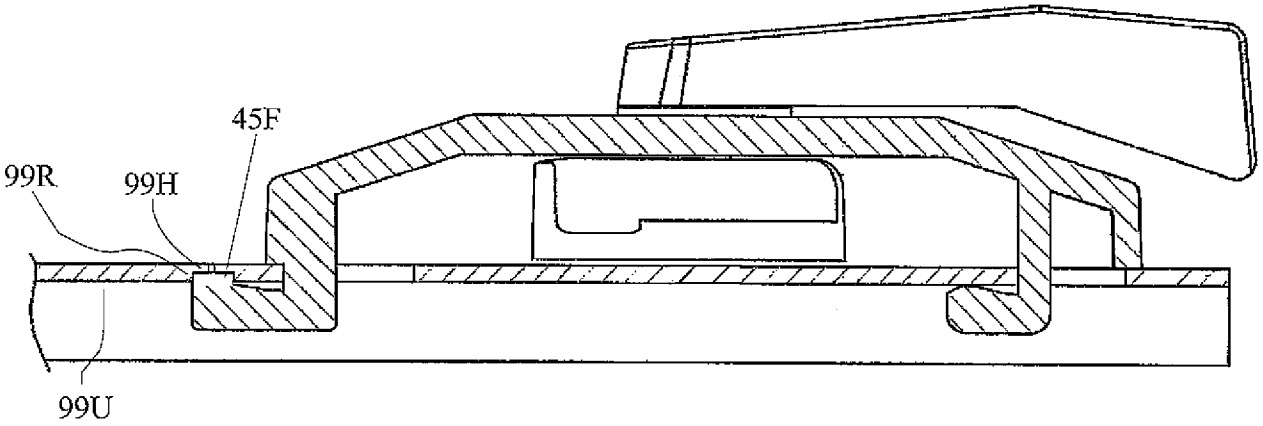
FIG. 9E is the cross-sectional view of the screwless sash lock of FIG. 1, after being installed into the rail/stile of FIG. 8B, but using a locking tab on the top surface of the foot of the first leg that is receiving in a recess on the underside of the rail-stile wall.

The locking tab 45 may alternatively be relocated from the previously noted position on the housing bottom surface 25. A locking tab 45F may instead extend upward from the flat section 29F of the first foot 29 of leg 27, as, as seen in FIG. 9E. Locking tab 45F may be received within a corresponding recess 99R in the underside 99U of the rail stile. A small orifice 99H may be provided in the rail/stile, and may be centered on the recess 99R, so that a small pin-like member may be inserted through the orifice to cause withdrawing of the locking tab 45F from the recess 99R, to thereby permit removal of the sash lock. With such a configuration for the foot, having a locking tab 45F thereon, a sash lock having only one strategically located foot (preferably being centrally located), may be used for screwless attachment of the sash lock to the rail/stile.

Figure 10F:
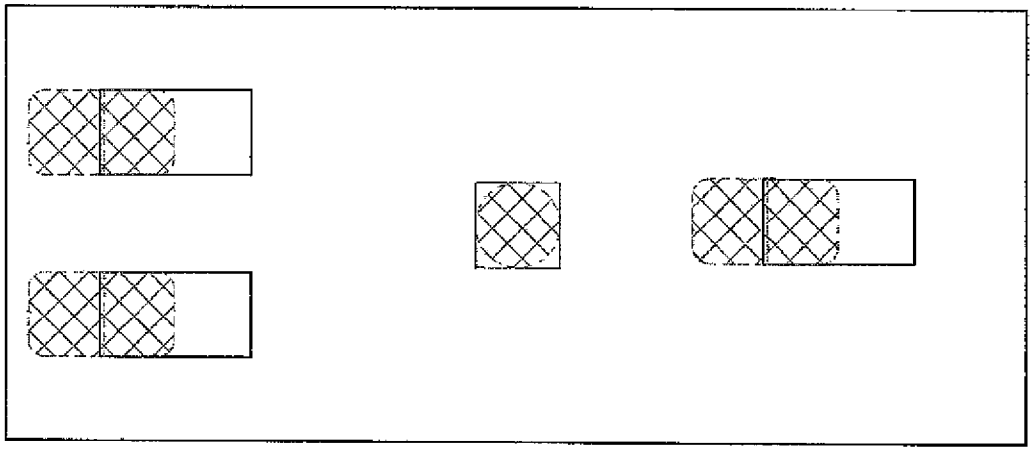
FIG. 10F is the bottom view of FIG. 10B but showing an alternative pattern for the legs of the sash lock housing and the openings in the rail/stile, having two legs with corresponding feet at the housing first end.
Figure 10H:
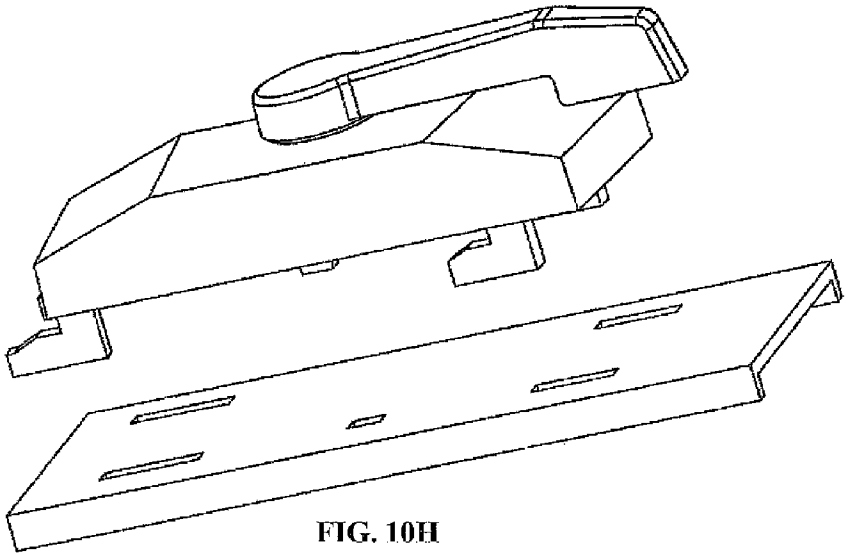
FIG. 10H is a perspective view of the sash lock with the four-leg embodiment of FIG. 10G.
Figure 10G:
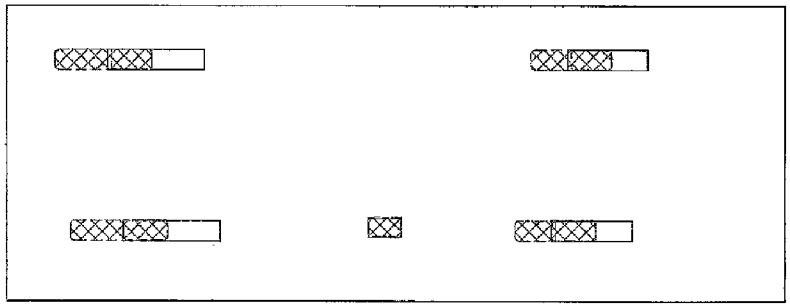
FIG. 10G is the bottom view of FIG. 10B but showing an alternative pattern for the legs of the lock housing and openings in the rail/stile, having two narrow legs with corresponding feet at the housing first end, and two narrow legs with corresponding feet at the housing second end.

As another alternative to the arrangement of the feet, more than one foot may be used at the first end of the housing for the sash lock, which is illustrated in the bottom view of FIG. 10F. In addition, a four-footed arrangement is shown in the bottom view of FIG. 10G and the perspective view of FIG. 10H.

Figure 11A:
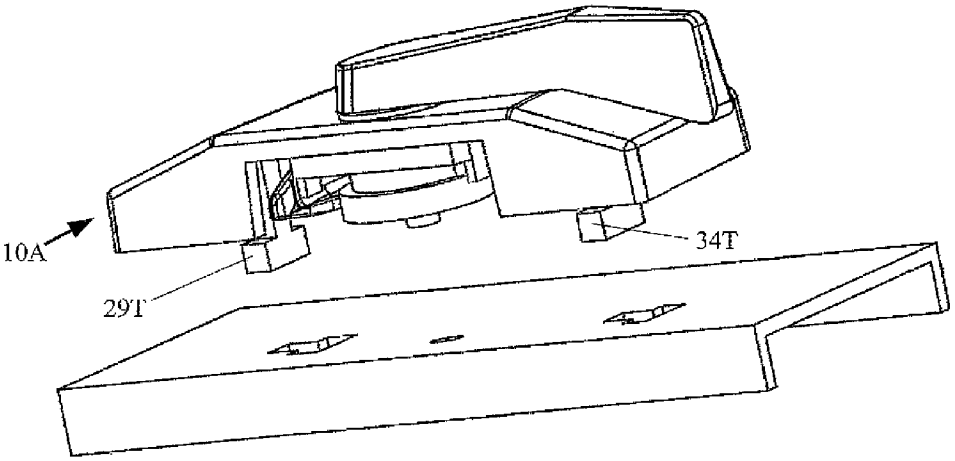
FIG. 11A is a perspective view of an alternative leg configuration for the first embodiment of the screwless sash lock of FIG. 1, having a T-shaped bottom, instead of the foot, and with the locking protrusion positioned beneath the shaft.
Figure 11B:
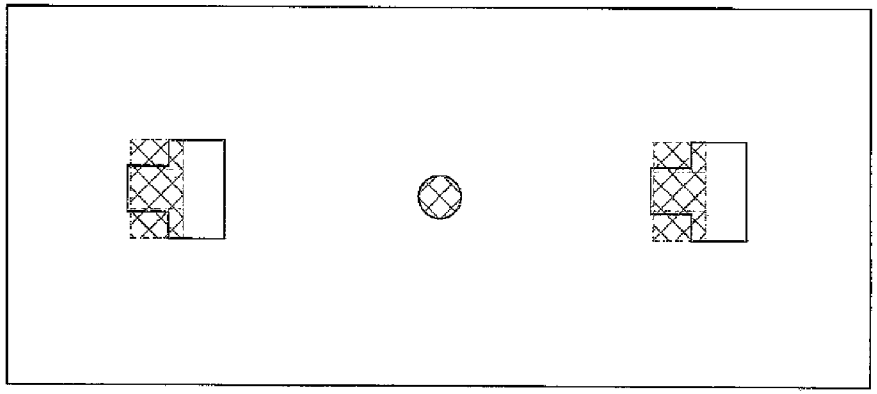
FIG. 11B is a bottom view of the rail/stile having the screwless sash lock according to FIG. 11A installed thereon, and showing the first foot and second foot of the legs and the locking tab secured in the corresponding openings in the rail/stile.
Figure 11C:
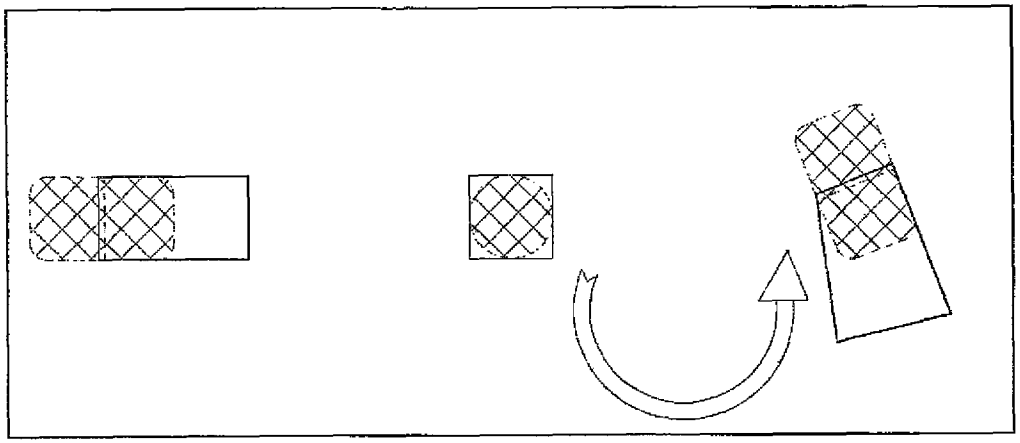
FIG. 11C is the bottom view of FIG. 11B but showing an alternative three-legged pattern for the legs of the lock housing, and oriented to and rotate in corresponding rail-stile openings.

An alternative to the general shape of the foot of the first and second legs of sash lock 10 is shown by the T-shaped bottom 29T and 34T on the legs of sash lock 10A in FIGS. 11A and 11B. Installation and removal of sash lock 10A may generally be accomplished the same as for sash lock 10.

Figure 12A:
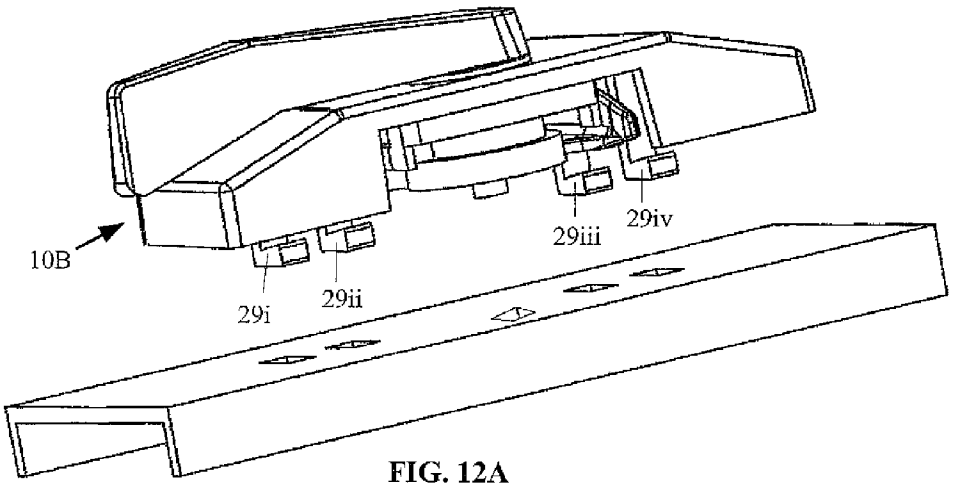
FIG. 12A is a perspective view of an alternative leg configuration for the first embodiment of the screwless sash lock of FIG. 1, having four feet that are oriented to slide laterally in the corresponding rail-stile openings, and with the locking protrusion being positioned beneath the shaft.
Figure 12B:
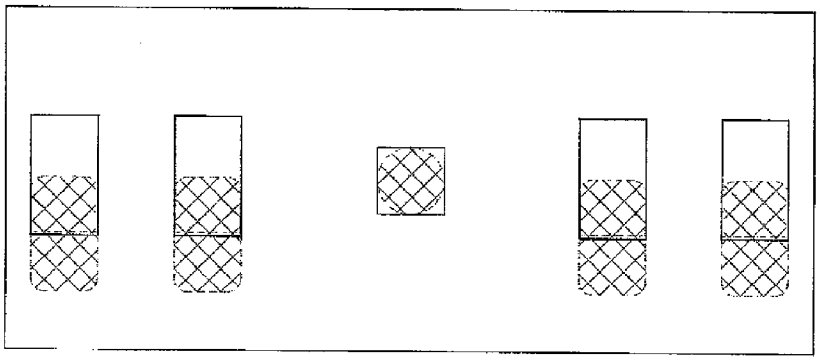
FIG. 12B is the bottom view of the rail/stile having the screwless sash lock according to FIG. 11A installed thereon.
Figure 12C:
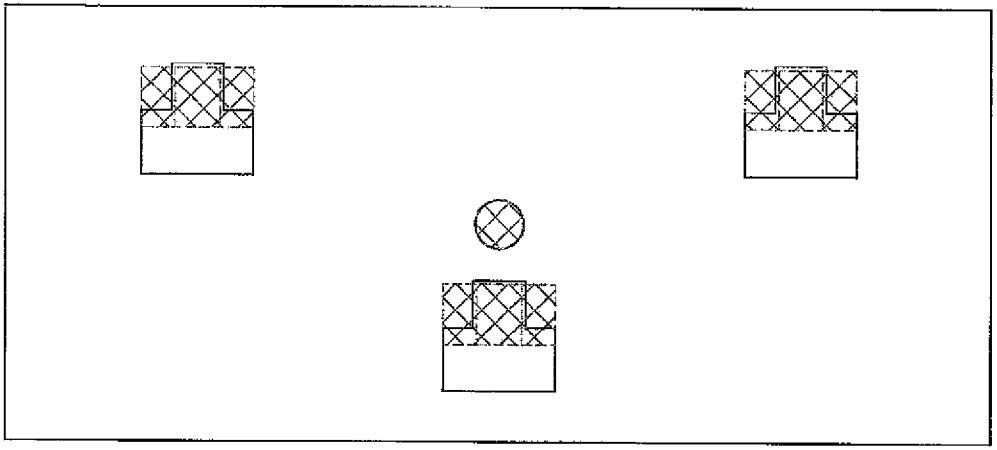
FIG. 12C is the bottom view of FIG. 11B but showing an alternative three-legged pattern for the legs of the lock housing, and oriented to slide laterally in corresponding rail-stile openings.

An alternative to the sliding motion (from the housing second end 22 toward the housing first end 21), for the installation of sash lock 10, may be provided by the arrangement of feet in the sash lock 10B in FIGS. 12A and 12B. Sash lock 10B may contain a series of four legs that may have a foot 29*i*, a foot 29*ii*, a foot 29*iii*, and a foot 29*iv* that are each oriented orthogonally to the line formed between the housing first and second ends. Installation of the sash lock 10B may proceed the same as with sash lock 10, except for the direction of the sliding force that must be inputted to the housing, which is apparent from the bottom view in FIG. 12B. A similar three-legged arrangement having staggered T-shaped leg members, similar to sash lock 10A, is represented by the bottom view in FIG. 12C.

Figure 13B:
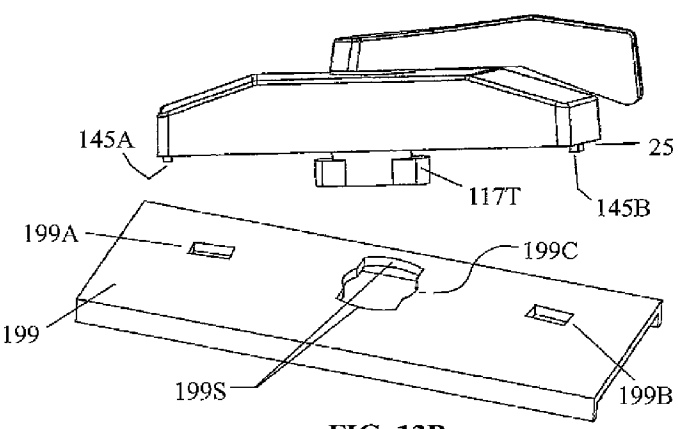
FIG. 13B is a second perspective view of the screwless sash lock and rail/stile of FIG. 13A.
Figure 13C:
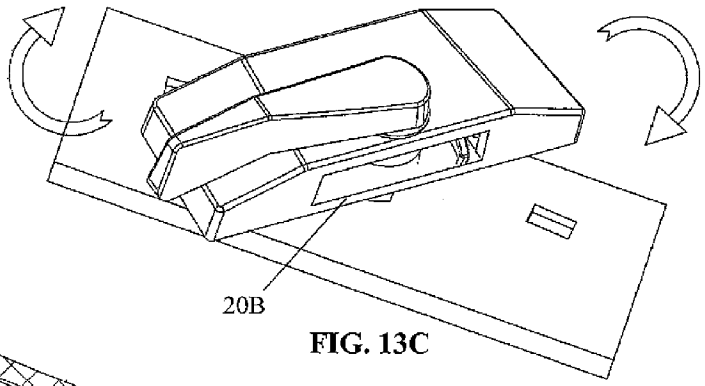
FIG. 13C is a perspective view of the screwless sash lock and rail/stile of FIG. 13A, with the T-shaped leg received through the rail-stile opening, and with the sash lock being rotated prior to engagement by the locking tabs in the corresponding rail-stile openings.
Figure 13A:
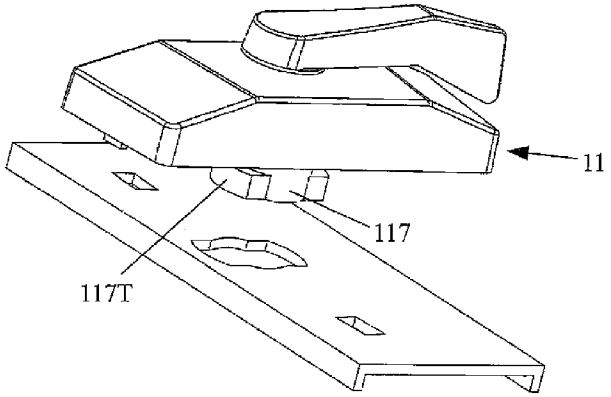
FIG. 13A is a perspective view of an alternative leg configuration for the first embodiment of the screwless sash lock of FIG. 1, having one T-shaped leg bottom on a leg that extends from a housing bottom wall beneath the shaft, and having first and second locking tabs disposed on opposite sides of the leg, with the locking tabs being received within rail-stile openings by rotation of the sash lock after inserting the T-shaped leg bottom into the corresponding opening.
Figure 13D:
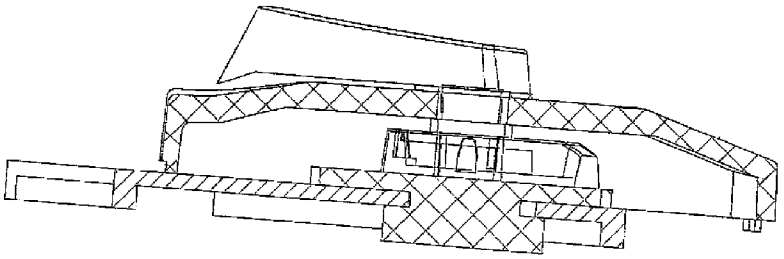
FIG. 13D is a cross-sectional view of the screwless sash lock and rail/stile of FIG. 13B, with the sash lock being rotated prior to engagement by the locking tabs in the corresponding rail-stile openings.
Figure 13E:
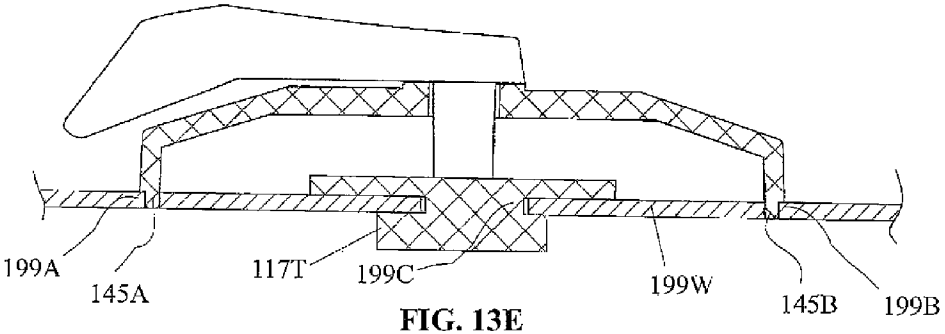
FIG. 13E is a cross-sectional view of the screwless sash lock and rail/stile of FIG. 13B, after the sash lock has been rotated for the locking tabs to engage the corresponding rail-stile openings.
Figure 13F:
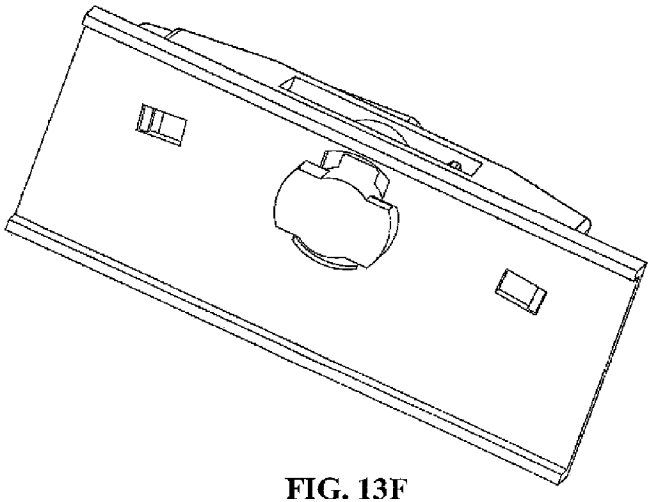
FIG. 13F is a bottom perspective view of the fully rotated and installed sash lock of FIG. 13E.

A different embodiment of the sash lock 10 is shown by screwless sash lock 11, which may use rotational motion for securing of the locking tab(s), and which is seen in FIG. 13A-13F. For sash lock 11, the housing wall 20 may also span across the bottom surface 25 to create a bottom facet 20B to further enclose the cavity (see FIG. 13C), into which the cam may be received. Extending downward from the housing wall facet 20B may be a cylindrical leg 117 that terminates in a T-shaped member 117T. The first and second ends of the sash lock 11 may each have a locking tab—tabs 145A and 145B—that protrude downward from housing bottom surface 25. The corresponding rail/stile 199 upon which sash lock 11 is to be installed may have an opening therein that includes a cylindrical orifice 199C, from which extends, in both directions, a slotted opening 199S. The rail/stile 199 may also have a first opening 199A and a second opening 199B, which are disposed about the cylindrical orifice 199C in a relation that corresponds to the relationship between the sash lock 11's locking tabs 145A and 145B, and cylindrical leg 117 with T-shaped member 117T. Thus, the cylindrical leg 117 and T-shaped member 117T may be inserted through the cylindrical orifice 199C and slotted opening 199S in the rail/stile, as seen in FIG. 13A. Through rotation of the sash lock 11, as seen in the perspective view of FIG. 13C and the cross-sectional view of FIG. 13D, the T-shaped member 117T of the sash lock may engage the wall 199W of the rail/stile, and the locking tabs 145A and 145B may be receive in the rail/stile openings 199A and 199B, as seen in FIGS. 13E and 13F, after approximately 90 degrees of rotation. Removal would require simultaneous withdrawing of the two locking tabs 145A and 145B from the openings 199A and 199B, in a procedure similar to that used for sash lock 10.

Figure 14E:
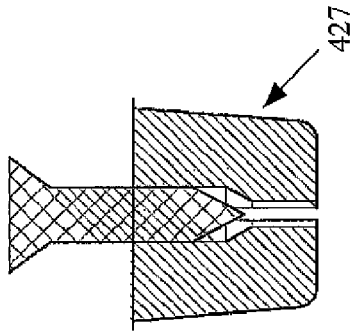
FIG. 14E is an enlarged cross-sectional view of an anchor-type leg of another embodiment of the sash lock of the present invention, which is installed using a screw.
Figure 14D:
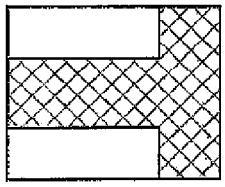
FIG. 14D is an enlarged cross-sectional view of the T-shaped foot of FIG. 14C, but having lateral support flanges extending from the leg to the foot.
Figure 14C:
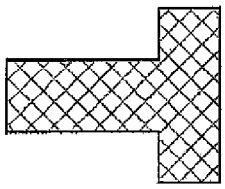
FIG. 14C is an enlarged cross-sectional view of the leg with T-shaped foot of the screwless sash lock of the present invention, as seen in FIG. 11A.
Figure 14B:
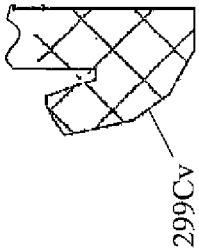
FIG. 14Bi is an enlarged cross-sectional view of the foot of a leg of a second embodiment of the screwless sash lock of the present invention, as seen in FIG. 12A.
Figure 14B:
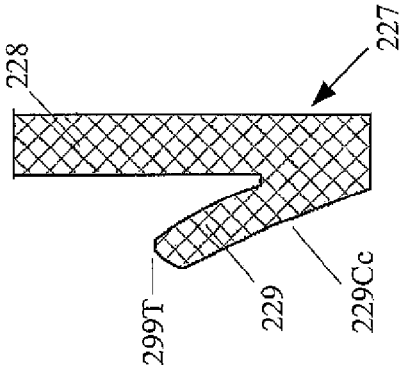
Figure 14A:
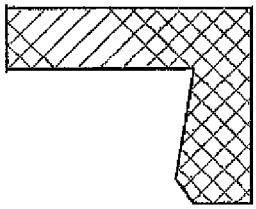
FIG. 14A is an enlarged cross-sectional view of the foot of the second leg of the screwless sash lock of the first embodiment, as seen in FIGS. 1 and 5.
Figure 15A:
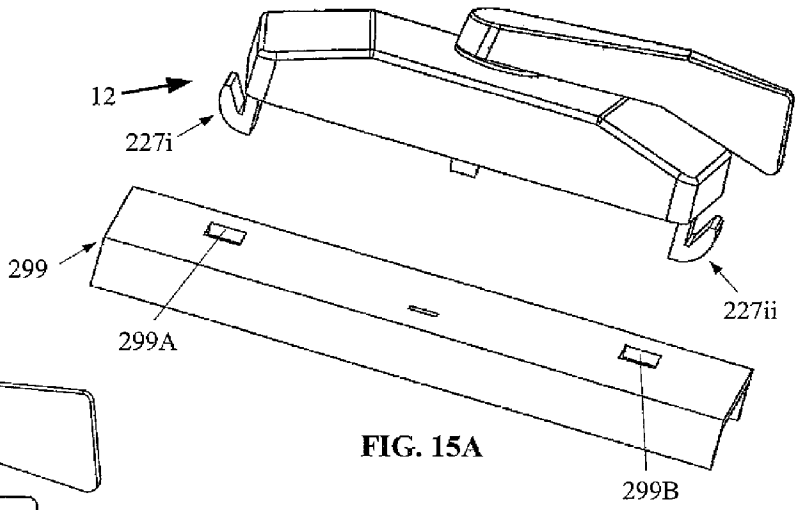
FIG. 15A is a perspective view of a first alternate embodiment of the screwless sash lock of the current invention, having first and second legs being adapted for only direct insertion into the corresponding rail/stile opening and having biased retention therein, rather than the insertion and sliding/rotational motion needed for installation of the first embodiment.
Figure 15B:
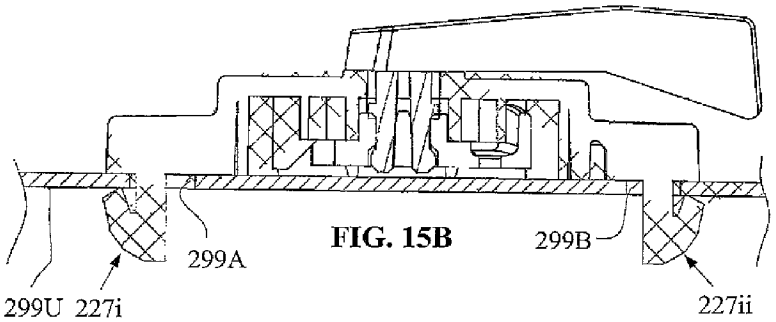
FIG. 15B is a cross-sectional view through the first alternate embodiment of the screwless sash lock in FIG. 15A.
Figure 15C:
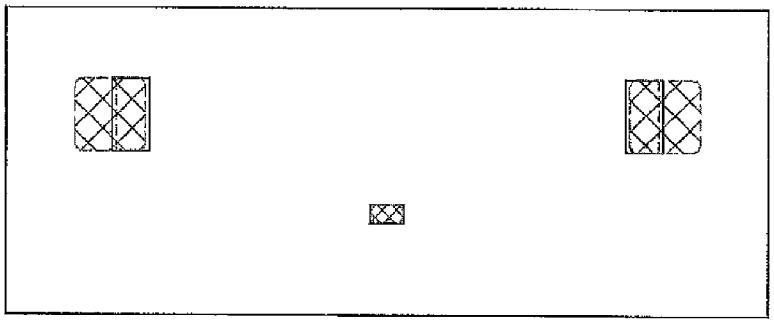
FIG. 15C a bottom view of the rail/stile having the screwless sash lock according to FIG. 15A installed thereon, with the first foot and second foot of the legs and the locking tab secured in corresponding rail/stile openings.

A comparison of alternative attachment means (leg and/or foot) for the screwless sash lock of the current invention is illustrated in FIGS. 14A-14E. The foot, as used for the first leg of sash lock 10, is seen in FIG. 14A, while the T-shaped member, as used for the sash lock 10A, is seen in FIG. 14C. FIGS. 14Bi and 15Bii illustrate a different leg/foot configuration 227 that is usable on another sash lock configuration—sash lock 12, which is illustrated in FIGS. 15A-15C. The leg/foot configuration 227 of FIG. 14Bi may include a down-standing leg 228 from which may protrude an up-standing leg 229, which curves away from leg 228 and terminates in a flat top surface 229T. The upstanding leg 229 may curve away from the down-standing leg 228 using a concave outer surface 229Cc, as seen in FIG. 14Bi, or using a convex outer surface 229Cv, as seen in FIG. 14Bii. The up-standing leg 229 may thus be elastically deflected towards or away from the down-standing leg 228, and may cause deflection of the down-standing leg 228, but both legs will seek to restore themselves to the undeflected position illustrated in FIG. 14B, once the deflecting force is removed.

Sash lock 12, as seen in FIG. 15A, may have first and second leg/foot combinations 227*i* and 227*ii*, protruding respectively from the bottom surface 25, which may, but need not necessarily be, respectively positioned at the first and second ends of the housing. The leg/foot combinations 227*i* and 227*ii* may face each other, or be oriented to face away from each other. Each of the leg-foot combinations, 227*i* and 227*ii*, may be formed by the aforementioned down-standing leg 228, and either of the upstanding legs 229Cc or 229Cv, although the concave outer surface of up-standing leg 229Cc is illustrated in FIGS. 15A and 15B. The two leg/foot protrusions, 227*i* and 227*ii*, may be received in corresponding openings 299A and 299B in the rail/stile 299. The openings 299A and 299B may be sized and positioned so that as the sash lock is advanced toward the rail/stile (FIG. 15A), the side of the rail/stile openings 299A/299B will cause deflection of the upstanding leg 229 and/or deflection of the down-standing leg 228 during insertion. As seen in FIG. 15B, once the upstanding leg 229 is fully inserted into the opening, the legs 28/29 may both spring back to the respective undeflected positions, with the tip 229T of the upstanding legs 229 then contacting the underside 299U of the rail stile 299 to maintain the sash lock in the installed position. The housing of sash lock 12 may, but need not have, a locking tab.

Figure 16A:
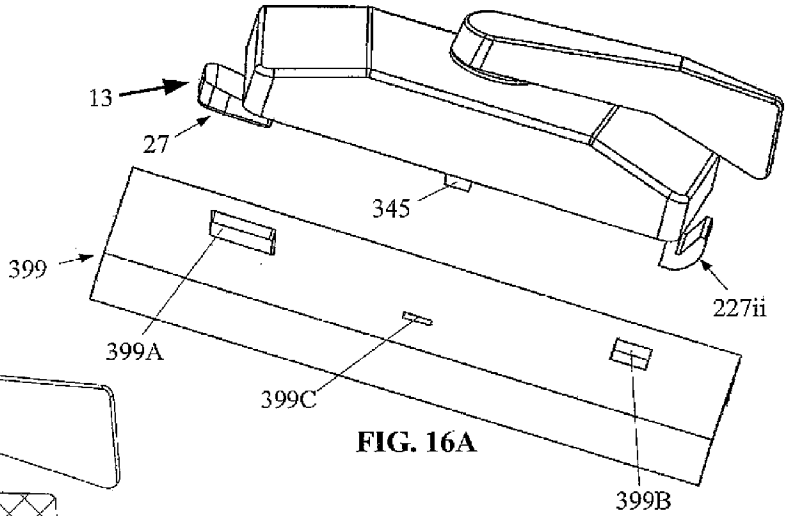
FIG. 16A is a perspective view of a hybrid embodiment of the screwless sash lock of the current invention, having the first leg being the same as for the first embodiment of the lock per FIG. 1, and the second leg being the same as for the first alternate embodiment in FIG. 15A.
Figure 16B:
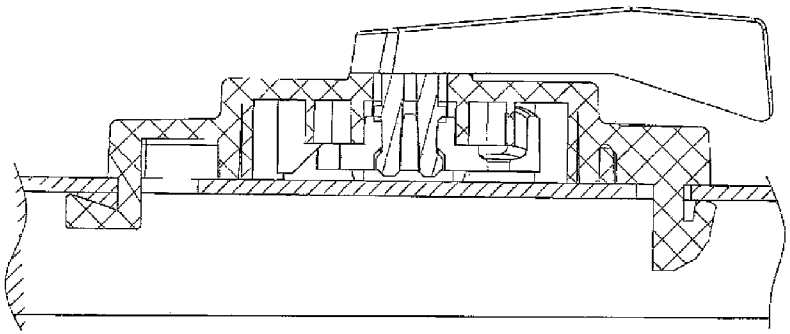
FIG. 16B is a cross-sectional view through the hybrid embodiment of FIG. 16A.
Figure 16C:
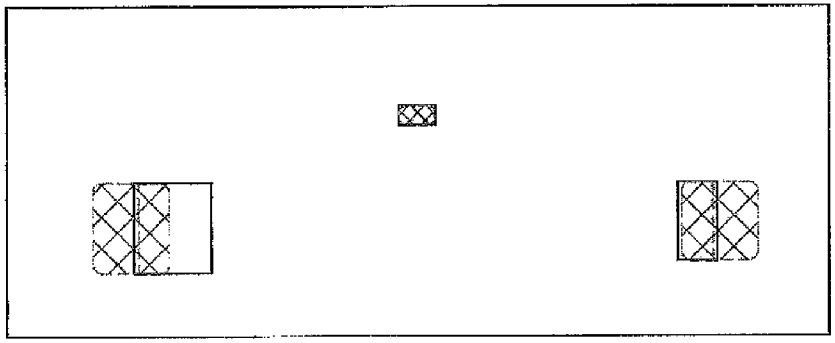
FIG. 16C a bottom view of the rail/stile having the hybrid sash lock embodiment of FIG. 16A installed thereon.
Figure 17B:
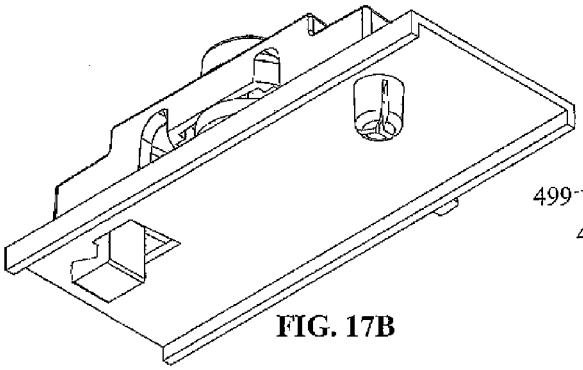
FIG. 17B is a bottom perspective view of the second hybrid lock embodiment of FIG. 17A, after being installed on the rail-stile.
Figure 17A:
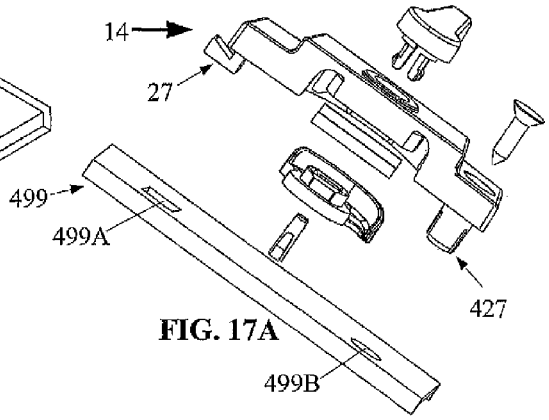
FIG. 17A is an exploded view of the parts comprising a second hybrid embodiment of the sash lock of the current invention, having the first leg being the same as for the first lock embodiment in FIG. 1, and having an expansion anchor per FIG. 14E receiving a single screw in place of the second leg.
Figure 17C:
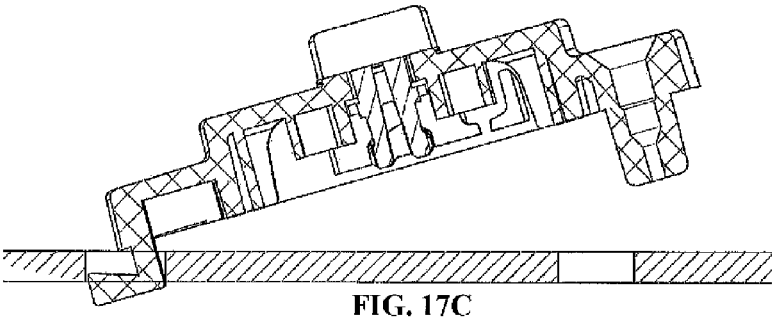
FIG. 17C is a cross-sectional view of the second hybrid lock embodiment of FIG. 17A, at the first step of its installation into the rail/stile.
Figure 17D:
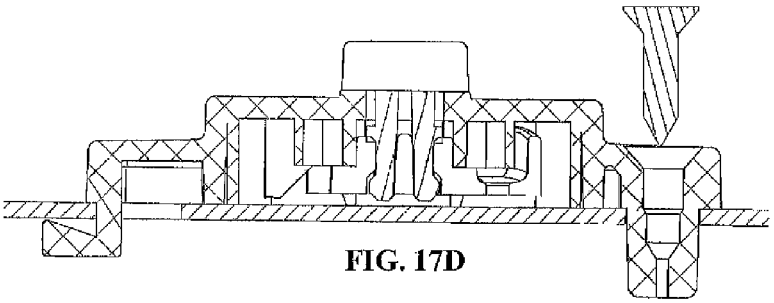
FIG. 17D is a cross-sectional view of the second hybrid lock embodiment of FIG. 17C, after rotation of the sash lock for insertion of the anchor into the orifice in the rail/stile.
Figure 17E:
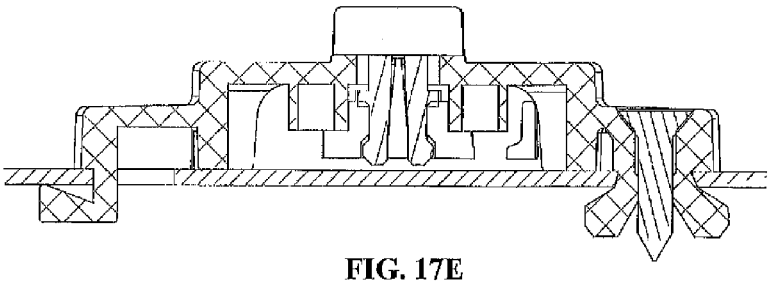
FIG. 17E is a cross-sectional view of the screwless sash lock of FIG. 17D, after the screw has been torqued into the anchor to cause lateral expansion of the anchor sections.

Sash lock 13, as seen in FIGS. 16A-16C, constitutes a hybrid embodiment in which the first housing end may comprise a leg 27 formed as per sash lock 10, and the second housing end may comprise a leg/foot 227*ii* formed as per sash lock 12. Installation of sash lock 13 into openings 399A and 399B of rail stile 399 may proceed the same as for sash lock 10, except that insertion of the leg/foot 227*ii* at the second housing end into opening 399B completes the installation, and no sliding motion thereafter is necessary. A locking tab 345 may be received into a third rail/stile opening 399C to provide additional stability to the sash lock housing in the installed position on the rail/stile.

Figure 20A:
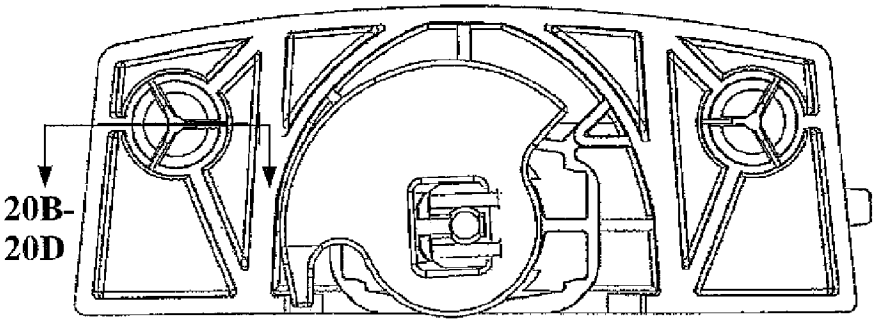
FIG. 20A is a bottom view of the third embodiment of the sash lock according to FIG. 18A.
Figure 20B:
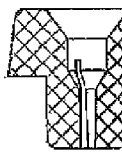
FIG. 20B is a vertical cross-section through the expansion anchor of the sash lock of FIG. 20A, showing a first configuration for the profile of the expandable section.
Figure 20C:
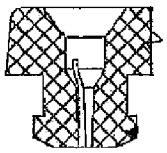
FIG. 20C is a vertical cross-section through the expansion anchor of the sash lock of FIG. 20A, showing a second configuration for the profile of the expandable section.
Figure 20D:
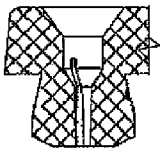
FIG. 20D is a vertical cross-section through the expansion anchor of the sash lock of FIG. 20A, showing a third configuration for the profile of the expandable section.

Sash lock 14, as seen in FIGS. 17A-17E, constitutes a second hybrid embodiment in which the first housing end may comprise a leg 27 formed as per sash lock 10, and the second housing end may comprise a leg in the form of the expansion anchor 427 of FIG. 14E. Expansion anchor 427 may be segmented into two or more vertical segments that each extend from the housing wall within the interior housing cavity, and may have an orifice therein to receive a screw. Installation of sash lock 14 into openings 499A and 499B of rail stile 499 (FIGS. 17C-17D) may also proceed the same as for sash lock 10, except that insertion of the expansion anchor 427 at the second housing end into rail-stile orifice 499B and the torquing of a screw within the orifice therein, serves to complete the installation, as no sliding motion is necessary. The orifice 499B of the rail-stile may be sized to receive the expansion anchor 427 in a small clearance fit, or a slight interference fit. Torquing the screw into the orifice with the expansion anchor 427 serves to open the individual expansion anchor segments, as seen within FIG. 18C, and thereby attach the sash lock 14 to the rail/stile 499. Instead of using the cylindrical expansion anchor of sash lock 14, other cross-sectional arrangements may be used, which are illustrated in FIGS. 19C-19G. In addition, variations on the plain cylindrical cross-section expansion anchor are illustrated within FIGS. 20B-20C, and which may improve upon the ability of the expansion segments to grip the rail/stile wall.

Figure 18A:
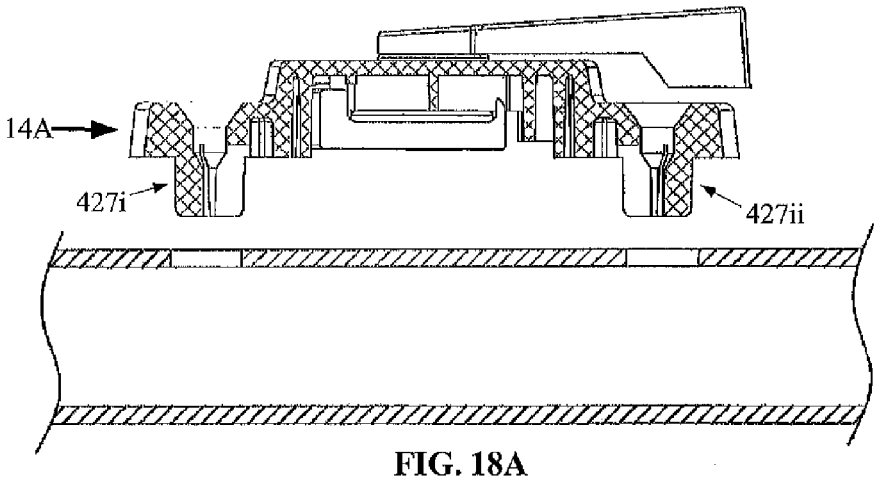
FIG. 18A is a cross-sectional view of a third embodiment of the sash lock of the present invention prior to its installation, and which requires uses two expansion anchors.
Figure 18B:
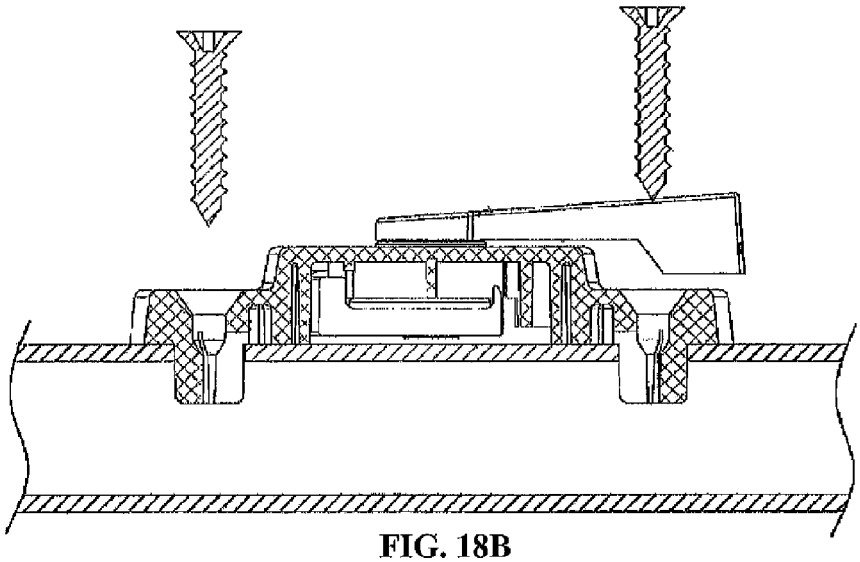
FIG. 18B is the cross-sectional view of FIG. 18A, after the first and second expansion anchors have been inserted into corresponding orifices in the rail-stile, but prior to torquing of the screws to complete the lock's installation onto the rail/stile.
Figure 18C:
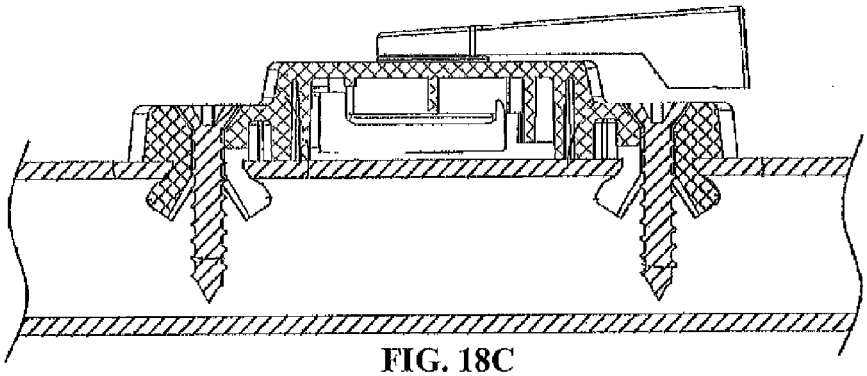
FIG. 18 C is the cross-sectional view of FIG. 18A, after the first and second expansion anchors have been inserted into corresponding orifices in the rail-stile, after torquing of the screws to complete the lock's installation.

A double expansion anchor embodiment is shown by sash lock by 14A in FIGS. 18A-18C. Sash lock 14A, as may be seen in the sequence of figures, simply requires insertion of the two expansion anchors 427*i* and 427*ii* into two orifices in the rail/stile, and torquing of two screws therein.

Figure 21B:
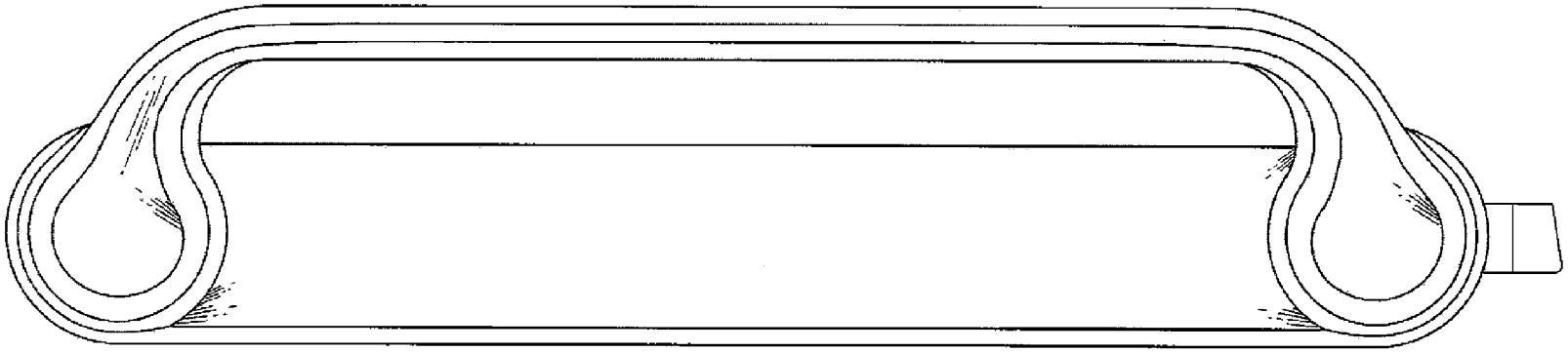
FIG. 21B is a top view of the handle of FIG. 21A.
Figure 21A:
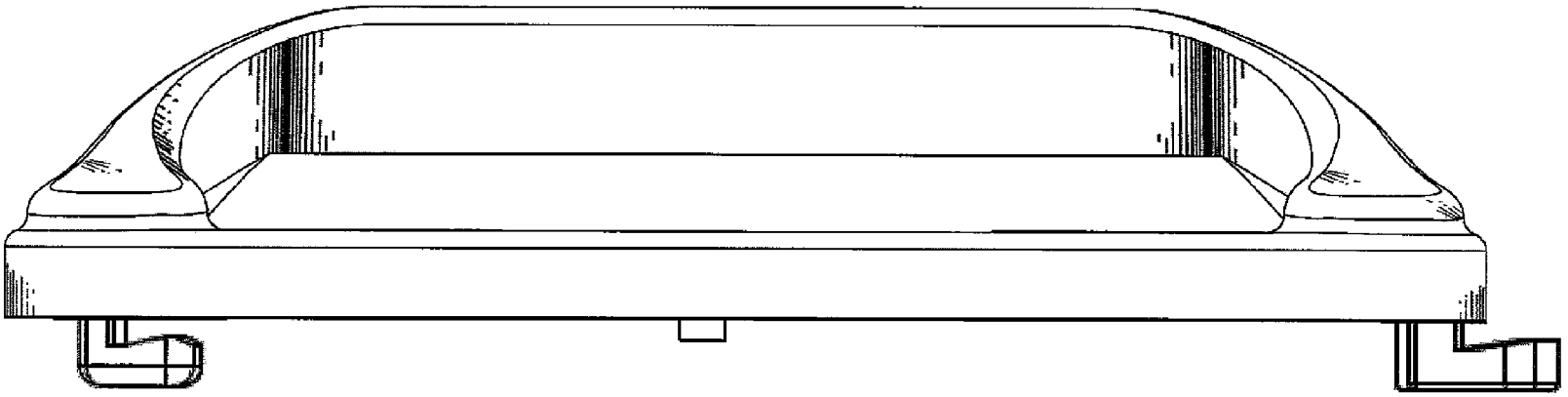
FIG. 21A is a side view of a door handle incorporating the legs and feet from the first embodiment of screwless sash lock of the present invention.

FIGS. 21A and 21B illustrate an alternative use of the first leg 27 and second leg 32 of the sash lock 10, whereby they for a screwless attachment means for a door handle.

The examples and descriptions provided merely illustrate certain preferred embodiments of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A screwless sash lock, said sash lock configured for installation of a portion thereof into coordinated openings in a meeting rail of a sash window, said sash lock comprising:

a housing having a first end and a second end, said housing comprising:

a housing wall configured to terminate on a generally flat bottom surface to enclose a cavity, said housing wall comprising an orifice into said cavity, and an opening into said cavity;

a first leg configured to extend beyond said bottom surface, and with a portion of a foot of said first leg configured to extend beyond said housing first end;

a second leg configured to extend beyond said bottom surface, said first and second legs configured to enter the coordinated openings of the sash window meeting rail and to be engaged therein through sliding contact, by said second leg configured to be oriented substantially the same as said first leg, where a foot of said second leg extends in the same direction as said foot of said first leg;

a locking tab configured to extend beyond said bottom surface, at a position between said first leg and said second leg; and wherein said first leg extends beyond said bottom surface at a position on said housing wall proximate to said housing first end, and said second leg extends beyond said bottom surface at a position proximate to said housing second end;

a shaft rotatably received within said orifice in said housing wall, a portion of said shaft being disposed within said housing cavity, and a graspable portion of said shaft being disposed outside of said housing cavity; and a cam fixedly secured to said portion of said shaft within said cavity, to be pivotable between a retracted position, and an extended position where at least a portion of said cam protrudes out from said opening in said housing wall.

2. The sash lock according to claim 1 wherein said locking tab protrudes from said bottom surface of said housing wall.

3. The sash lock according to claim 1 wherein a portion of said first leg is integral with said wall at said housing first end; and wherein a portion of said second leg is proximate to, but displaced from, said housing wall at said housing second end.

4. The sash lock according to claim 1 wherein at least a portion of a top surface of said foot of said first leg extends generally parallel to said generally flat housing bottom surface.

5. The sash lock according to claim 4 wherein a top surface of said foot of said second leg is configured to form an apex.

6. The sash lock according to claim 5 further comprising a leaf spring, a portion of said leaf spring configured to releasably engage said cam when in said retracted and said extended positions.

7. The sash lock according to claim 6 further comprising a protrusion configured to protrude from said housing wall into said cavity, to have a first side of said protrusion positioned to stop said pivoting of said cam at said retracted position, and with a second side of said protrusion configured to stop said pivoting of said cam at said extended position.

8. The sash lock according to claim 7 further comprising a handle configured to extend laterally from said portion of said shaft disposed outside of said housing cavity.

9. The sash lock according to claim 8 wherein said shaft and cam are rotated approximately 180 degrees between said retracted and extended positions.

10. A sash lock comprising:

a housing having a first end and a second end, said housing comprising:

a housing wall configured to terminate on a bottom surface to enclose a cavity, said housing wall comprising an orifice into said cavity, and an opening into said cavity;

a first leg configured to protrude beyond said bottom surface, and with a portion of a foot of said first leg configured to extend beyond said housing first end;

a second leg configured to protrude beyond said bottom surface and to be oriented substantially the same as said first leg;

a locking tab configured to protrude beyond said bottom surface, at a position between said first leg and said second leg; and wherein said first leg extends beyond said bottom surface at a position on said housing wall proximate to said housing first end, and said second leg extends beyond said bottom surface at a position proximate to said housing second end;

a shaft being rotatably received within said orifice in said housing wall, a first portion of said shaft being disposed within said housing cavity, and a second portion of said shaft being disposed outside of said wall; and a cam fixed to said shaft and pivotable between a retracted position, and an extended position where at least a portion of said cam protrudes out from said opening in said housing wall.

11. The sash lock according to claim 10 wherein a portion of said first leg is integral with said wall at said housing first end; and wherein a portion of said second leg is proximate to, but displaced from, said housing wall at said housing second end.

12. The sash lock according to claim 10 wherein said housing bottom surface is substantially flat; and wherein at least a portion of a top surface of said foot of said first leg extends generally parallel to said substantially flat housing bottom surface.

13. The sash lock according to claim 12 wherein a portion of a top surface of a foot of said second leg is configured to form an apex.

14. The sash lock according to claim 10 wherein a foot of said second leg extends in the same direction as said foot of said first leg.

* * * * *